US007730648B2

(12) United States Patent
Fukaya

(10) Patent No.: US 7,730,648 B2
(45) Date of Patent: Jun. 8, 2010

(54) CONSTRUCTION VEHICLE

(76) Inventor: Hiroshi Fukaya, 4-12-3, Mihara, Asaka-shi, Saitama (JP)

( * ) Notice: Subject to any disclaimer, the term of this patent is extended or adjusted under 35 U.S.C. 154(b) by 0 days.

(21) Appl. No.: 12/233,686

(22) Filed: Sep. 19, 2008

(65) Prior Publication Data

US 2009/0282709 A1 Nov. 19, 2009

(30) Foreign Application Priority Data

May 14, 2008 (JP) ..... 2008-126705

(51) Int. Cl.
*E02F 3/32* (2006.01)
*E02F 3/65* (2006.01)
*E02F 3/00* (2006.01)

(52) U.S. Cl. ..... 37/443; 37/418; 414/710; 414/715

(58) Field of Classification Search ..... 37/443, 37/418, 432, 433, 445, 444, 442; 414/710, 414/715
See application file for complete search history.

(56) References Cited

U.S. PATENT DOCUMENTS 3,024,920 A * 3/1962 Sundin ..... 212/300
3,329,283 A * 7/1967 Wade ..... 212/300
3,417,891 A * 12/1968 Smelcer ..... 414/715
3,484,005 A * 12/1969 Guinot ..... 414/694
3,575,307 A * 4/1971 Guinot ..... 414/694
3,612,310 A * 10/1971 Schaeff ..... 414/694
3,891,065 A * 6/1975 Iijima et al. ..... 188/41
3,993,206 A * 11/1976 Jomen et al. ..... 414/695
4,272,222 A * 6/1981 Davis ..... 414/694
5,000,269 A * 3/1991 Aoki et al. ..... 172/248
5,295,318 A * 3/1994 Schaeff ..... 37/379
5,778,569 A * 7/1998 Schaeff ..... 37/410
6,071,066 A * 6/2000 Braud ..... 414/686
6,609,622 B2 * 8/2003 Forsyth ..... 212/258
6,643,577 B1 * 11/2003 Swick et al. ..... 701/50

(Continued)

*Primary Examiner*—Thomas B Will
*Assistant Examiner*—Abigail A Risic
(74) *Attorney, Agent, or Firm*—Browdy and Neimark, PLLC

(57) ABSTRACT

A construction vehicle of an all-round traverse type is configured such that when working by using one working machine of an excavating machine and a loading machine mounted on front and rear sides of a cabin, the working machine in use can perform operation without influence from the other working machine in an unused state, as the excavating machine and the loading machine are configured to be folded and retracted under an unused state into an orientation of substantially fitting along respective surfaces of the front side and the rear side of the cabin. A cabin 3 is mounted on a turn frame 2 that makes an all-round traverse and is mounted on a vehicle body 1, and a mounting bracket 40 is provided on one end of the front end and the rear end of the turn frame 2. An excavator 4 is mounted in front of the cabin 3 by mounting and connecting the excavator 4 to the mounting bracket 40. Boom stands 50 on which a loading machine is to be mounted is provided on both right and left sides of the turn frame 2, and root ends of right and left booms 5*a* and 5*a* of a bucket loader 5 are mounted and connected to the boom stands 50. Accordingly, the bucket loader 5 is mounted on the vehicle body 1 such that a bucket 5*b* supported on tip ends of the booms 5*a* rises and falls along the rear surface of the cabin 3.

2 Claims, 5 Drawing Sheets

U.S. PATENT DOCUMENTS 7,043,858 B2 * 5/2006 Martinez ..... 37/443
2004/0006899 A1 * 1/2004 Koch ..... 37/443
2006/0150447 A1 * 7/2006 Bates ..... 37/443
2008/0313935 A1 * 12/2008 Trifunovic ..... 37/413

* cited by examiner

CONSTRUCTION VEHICLE

BACKGROUND OF THE INVENTION

1. Field of the Invention

The present invention relates to an improvement in a construction machine (construction vehicle) that includes two working machines, namely, an excavating machine that performs excavating works, such as an excavator, and a loading machine that performs loading works, such as a bucket loader, both of which are mounted on a vehicle body configured to run with travel devices including crawlers or wheels.

2. Description of Related Art

Conventionally, there has been known a construction vehicle equipped with, for example, a bucket loader as a loading machine to perform loading works mounted on a vehicle body configured to run with crawlers or wheels, and additionally equipped with an excavator mounted on the vehicle body as a working machine to perform excavating works.

The conventional construction vehicle equipped with the two working machines includes a cabin on the upper side of the vehicle body configured to run with the crawlers or the wheels, and an excavator that performs excavating works mounted on the front end of the vehicle body in front of the cabin, and configured to swivel and to rotate rightward and leftward, and additionally a working machine for loading, such as a bucket loader, is installed on the rear end of the vehicle body for an excavation operator to perform loading and carrying works as an option during an excavating work. The conventional construction vehicle is not an all-round traverse type. Conventionally, among construction vehicles configured such that a turn frame is mounted on the upper side of the vehicle body of the construction vehicle in a 360-degree rotatable manner via a turn bearing that turns around a vertical axis, and a cabin and a working machine are mounted on the turn frame, and the working machine is configured to work by shifting a working position around the vehicle body by turning the turn frame, there has been known no construction vehicle of an all-round traverse type that includes two working machines of an excavating machine and a loading machine.

The reason for this is because the loading machine is built and supported on the vehicle body of the construction vehicle in a working-position fixed manner, because a loading work performed by the loading machine, such as a bucket loader, can be performed by moving a bucket of the working machine forward and backward, hoisting and lowering it upward and downward, and making a dumping-turn of it.

Furthermore, if the loading machine is mounted on the rear side of the vehicle body of the construction vehicle of the all-round traverse type in a working-position fixed manner; when turning the turn frame equipped with the excavating machine, interference with the loading machine mounted on the rear side of the vehicle body occurs, and turning operation of the turn frame cannot be performed. Even if the turn frame can be turned; when the turn frame is turned 180 degrees, and the working position of the excavating machine is located in a rearward position of the construction machine, the excavating machine overlaps with the loading machine provided on the rear side of the vehicle body of the construction vehicle, so that the excavating machine cannot work.

The above problem arising when a vehicle body of a construction vehicle of an all-round traverse type includes two working machines, namely, an excavating machine and a loading machine, can be solved as a cabin is mounted on the upper side of a turn frame mounted in a 360-degree rotatable manner via a turn bearing on the upper side of the vehicle body, a driver seat and a controlling device are installed inside the cabin, the excavating machine is mounted on the front end of the turn frame in front of the cabin, and the loading machine is mounted on the rear end of the turn frame on the rear side of the cabin.

However, because a loading machine, particularly a bucket loader, which is the most universal equipment, is configured such that a bucket is supported on a turn end of a large boom that rises and falls and turns so as to make a bumping-turn of the bucket as required; if the loading machine is installed at the rear end of the turn frame on which the excavating machine is supported at the front end, operation of turning the turn frame when performing an excavating work by the excavating machine supported at the front end of the turn frame is largely influenced by the loading machine provided at the rear end of the turn frame, such as a bucket loader, which includes a long and large boom configured to rise and fall and turn and projects backward largely, consequently, a smooth turn operation cannot be obtained. Moreover, another problem arises such that the construction vehicle cannot be used in a narrow space and a location of use is limited, because the construction vehicle requires a large working space around the vehicle body due to the bucket loader that is configured to project backward largely from the turn frame when turning the turn frame.

An object of the present invention is to provide a construction vehicle of an all-round traverse type that when working by using one working machine of an excavating machine and a loading machine mounted on a front side and a rear side of a cabin, the working machine in use can perform operation without influence from the other working machine in an unused state, as the excavating machine and the loading machine are configured to be folded and retracted under an unused state into an attitude of substantially fitting along respective outer surfaces of the front side and the rear side of the cabin, to construct a construction vehicle of an all-round traverse type that an excavating machine and a loading machine are mounted on a front side and a rear side of a cabin mounted on a turn frame, by mounting onto the upper side of the turn frame the cabin inside which a driver seat, a control device, and the like are accommodated and placed, mounting the excavating machine on one end of the front end of the turn frame on the front side of the cabin and the rear end of the turn frame on the rear side of the cabin, and mounting the loading machine on the other end of the turn frame, on the construction vehicle of an all-round traverse type that includes the turn frame being mounted on a vehicle body in a 360-degree rotatable manner with respect to a vertical rotational axis via a turn bearing, the cabin and the working machines being mounted on the turn frame, and a driver seat, a control device, and the like being installed in the cabin,

SUMMARY OF THE INVENTION

According to the present invention, in one aspect thereof, there is provided a construction vehicle characterized in that a turn frame 2 that turns 360 degrees around a rotational axis in a vertical direction is mounted on a vehicle body 1 configured to run with a travel device 10, a cabin 3 in which a driver seat and a control device are placed is mounted on an upper side of said turn frame 2, a mounting bracket 40 on which an excavating machine is to be mounted is provided on one end of front and rear ends of said turn frame 2, an excavator 4 is mounted on a front side of said cabin 3 by mounting and connecting a root end of a boom 4*a* of said excavator 4 to said mounting bracket 40, boom stands 50 on which a loading machine is to be mounted are provided on both right and left sides of said turn frame 2, a bucket loader 5 is mounted on said boom stands 50 such that a bucket 5*b* supported on tip ends of right and left booms 5*a* and 5*a* of said bucket loader 5 rises and falls along a rear surface of said cabin 3 by mounting and connecting root ends of said right and left booms 5*a* and 5*a* to said boom stands 50, and said excavator 4 and said bucket loader 5 both of which make an all-round traverse integrally with said turn frame 2 are installed on a front end and a rear end of said vehicle body 1.

According to the present invention, in another aspect thereof, there is provided a construction vehicle characterized in that a turn frame 2 that turns 360 degrees around a rotational axis in a vertical direction is mounted on a vehicle body 1 configured to run with a travel device 10, a cabin 3 in which a driver seat and a control device are placed is mounted on an upper side of said turn frame 2, a mounting bracket 40 on which an excavating machine to be mounted on one side of a front side and a rear side of said vehicle body 1 is to be mounted is provided on one end of front and rear ends of said turn frame an excavator 4 is mounted on said mounting bracket 40 such that said excavator 4 can be transformed into a retracted orientation along a front surface of said cabin 3, boom stands 50 and 50 on which a loading machine to be mounted on the other side of the front side and the rear side of said vehicle body 1 is to be mounted are provided on both right and left sides of said turn frame 2, a bucket loader 5 is mounted on said boom stands 50 and 50 such that a bucket 5*b* supported on tip ends of right and left booms 5*a* and 5*a* rises and falls along a rear surface of said cabin 3 by connecting and pivotally supporting root ends of said right and left booms 5*a* and 5*a* of said bucket loader 5 to said boom stands 50 and 50, each of said right and left booms 5*a* and 5*a* of said bucket loader 5 is divided into a tip-end side 5*a*-2 that supports said bucket 5*b* and a root-end side 5*a*-1 that is connected to said boom stand 50, said tip-end side 5*a*-2 is connected to said root-end side 5*a*-1 in a foldable and rotatable manner so as to be folded onto an upper side of said root-end side 5*a*-1, and working machines that make an all-round traverse are mounted on both the front side and the rear side of said vehicle body 1 such that when using one of said working machines, the other working machine that is unused is kept in a state not causing any problem to said working machine in use.

According to the present invention, in still another aspect thereof, there is provided the construction vehicle, wherein said bucket loader 5 and said excavator 4 built and mounted on said turn frame 2 as arranged on one side and the other side of front and rear sides of said cabin 3 are each equipped with anyone of a manual locking mechanism and an automatic locking mechanism that keeps each of said bucket loader 5 and said excavator 4 in a folded and retracted state when being folded and retracted. According to the present invention, in still another aspect thereof, there is provided the construction vehicle, wherein said boom stands 50 provided on both right and left sides of said turn frame 2 for mounting a loading machine are arranged in a position shifted forward and placed to stand on said turn frame 2 so as to be positioned at a substantially center in a fore and aft direction of said cabin 3 mounted on said turn frame 2 in a side view, and said bucket loader 5 is mounted on said boom stands 50 as shifted forward with respect to said cabin 3 such that said root-end sides 5*a*-1 of said right and left booms 5*a* occupy a position shifted forward to overlap with said cabin 3, and said tip-end sides 5*a*-2 of said booms 5*a* supporting said bucket 5*b* occupy a position to rise and fall on the rear side of said cabin 3.

According to the present invention, in still another aspect thereof, there is provided the construction vehicle, wherein each of said right and left booms 5*a* of said bucket loader 5 of which root ends are connected and pivotally supported by said boom stands 50 provided on both sides of said turn frame 2 is divided in a middle in a longitudinal direction into said tip-end side 5*a*-2 that supports said bucket 5*b* on a tip end, and said root-end side 5*a*-1 that is connected to and pivotally supported by said boom stand 50 via a boom pin 51, and said tip-end side 5*a*-2 is connected to said root-end side 5*a*-1 such that said tip-end side 5*a*-2 can fold and turn upward and cannot fold and turn downward owing to a joint pivot 60 positioned on an upper side of said boom 5*a*, and mating portions 61 and 62 that are provided so as to mate divided portions. According to the present invention, in still another aspect thereof, there is provided the construction vehicle, wherein said cabin 3 that includes a drive seat and a control device inside a room of said cabin 3, and is mounted on the upper side of said turn frame 2 is mounted as shifted to one side of right and left sides on the upper side of said turn frame 2, a power source 6 including an engine and a hydraulic power unit is mounted on the other side of the right and left sides on the upper side of said turn frame 2 in parallel with said cabin 3, said mounting bracket 40 for mounting an excavating machine to be provided on the front end of said turn frame 2 is provided at a position that occupies a substantially center in a right and left width of said cabin 3 such that said mounting bracket 40 is shifted from a center line Y between right and left of said turn frame 2 to said cabin 3 arranged in parallel with said power source 6 in a front view, and said excavator 4 mounted on said mounting bracket 40 is configured to be retracted substantially within a right and left width of said turn frame 2 in a front view, when said excavator 4 is retracted into a sideways attitude by turning around a swing post pin 41.

DETAILED DESCRIPTION OF PREFERRED EMBODIMENT(S)

Exemplary embodiments of the present invention will be explained below in detail with reference to the accompanying drawings.

Figure 1:
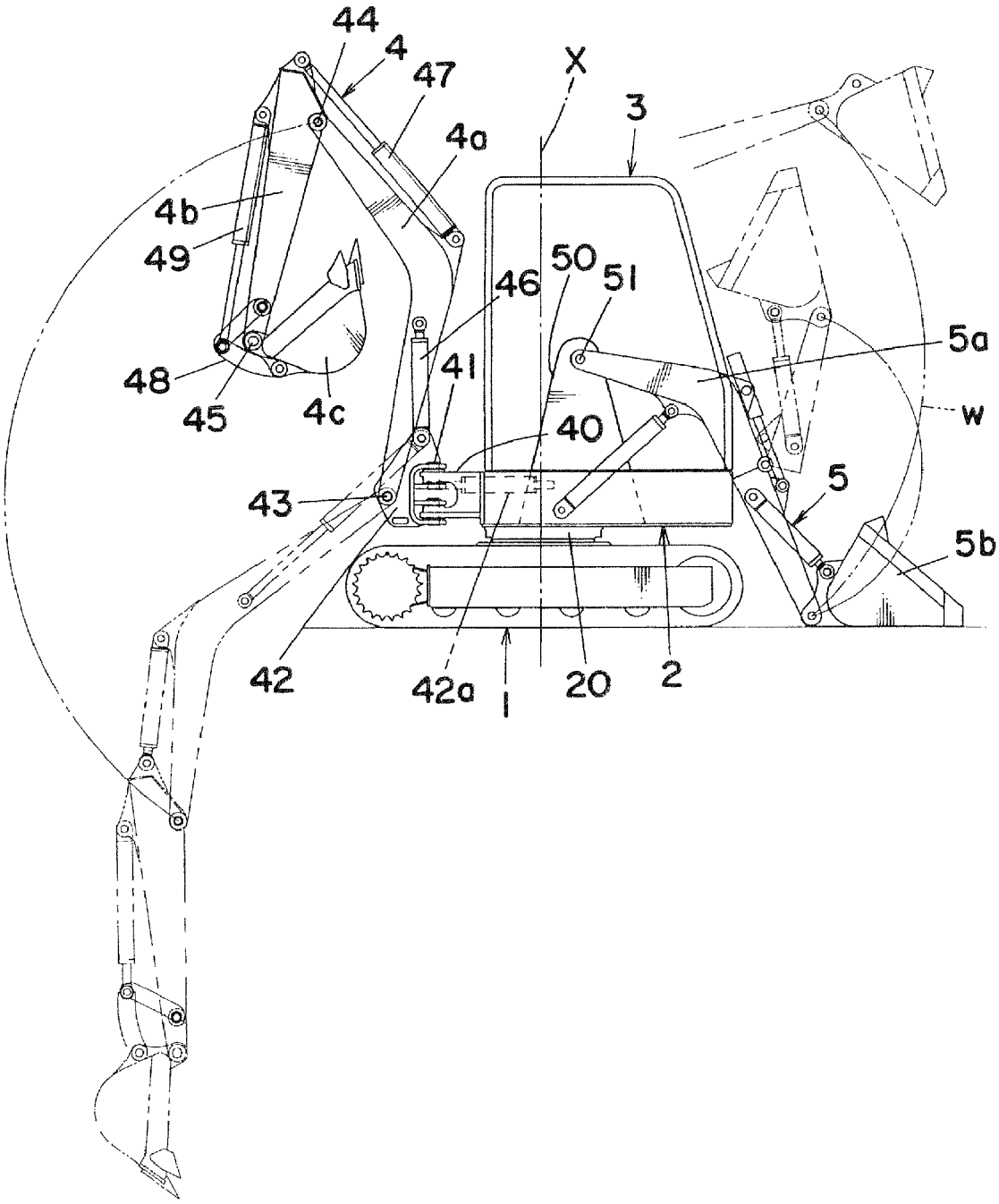
FIG. 1 is a side view of a construction vehicle according to an embodiment of the present invention.
Figure 2:
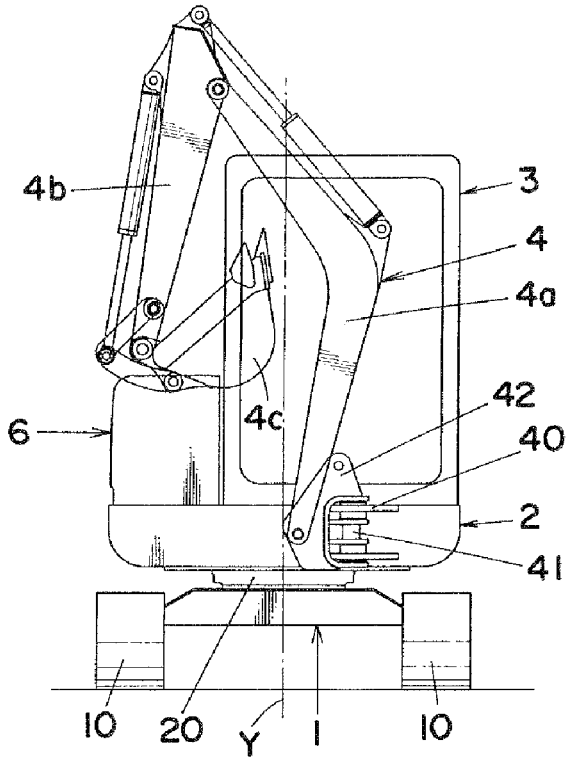
FIG. 2 is a front view of the construction vehicle shown FIG. 1 in a state where an attached excavating machine is folded and retracted in front of a cabin.
Figure 3:
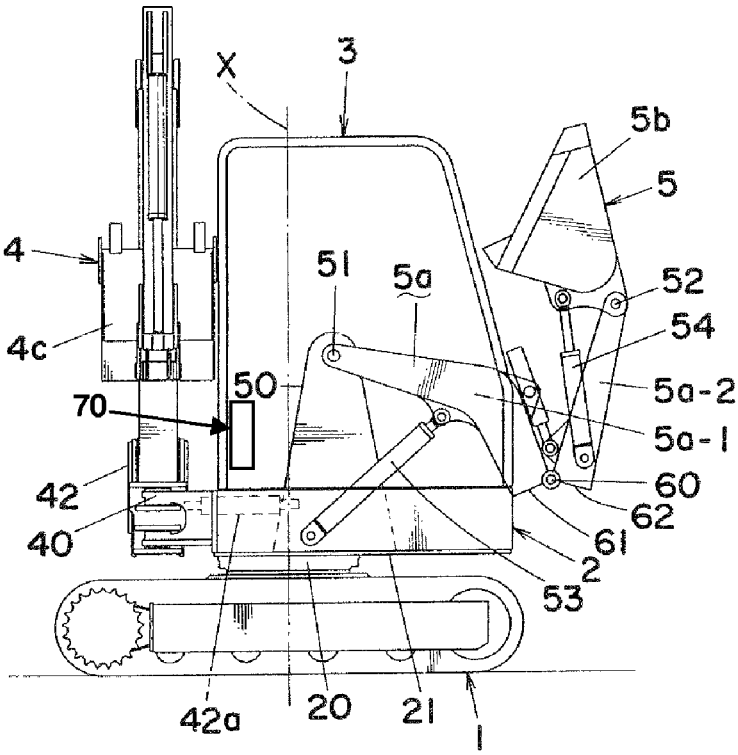
FIG. 3 is a side view of the construction vehicle shown in FIG. 1 in a state where the excavating machine and a loading machine arranged on the front side and the rear side of the cabin, respectively, are both folded and retracted.
Figure 4:
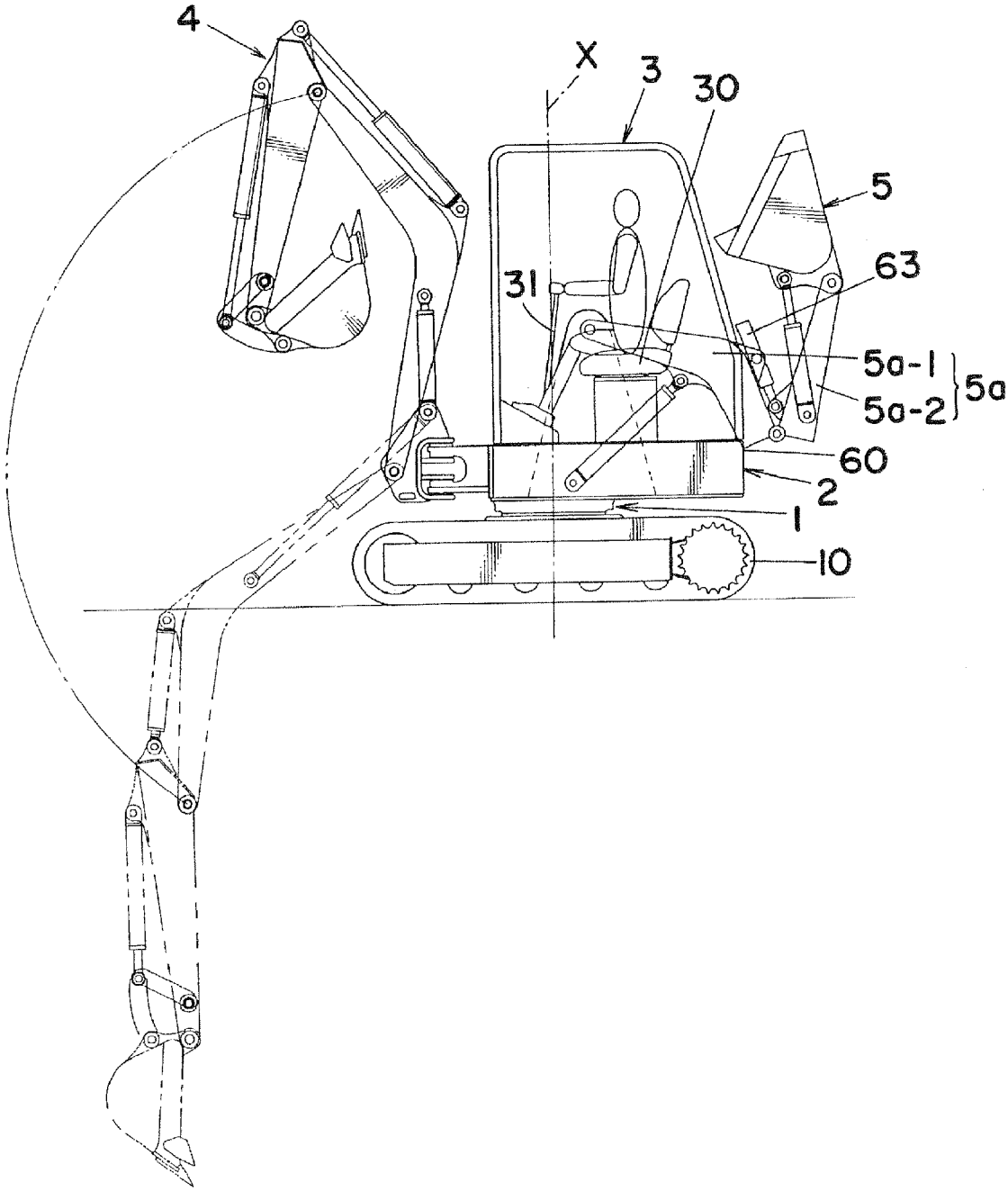
FIG. 4 is a side view of the construction vehicle shown in FIG. 1, when performing an excavating work by using the excavating machine, while keeping the loading machine in an attitude of being folded and retracted.
Figure 5:
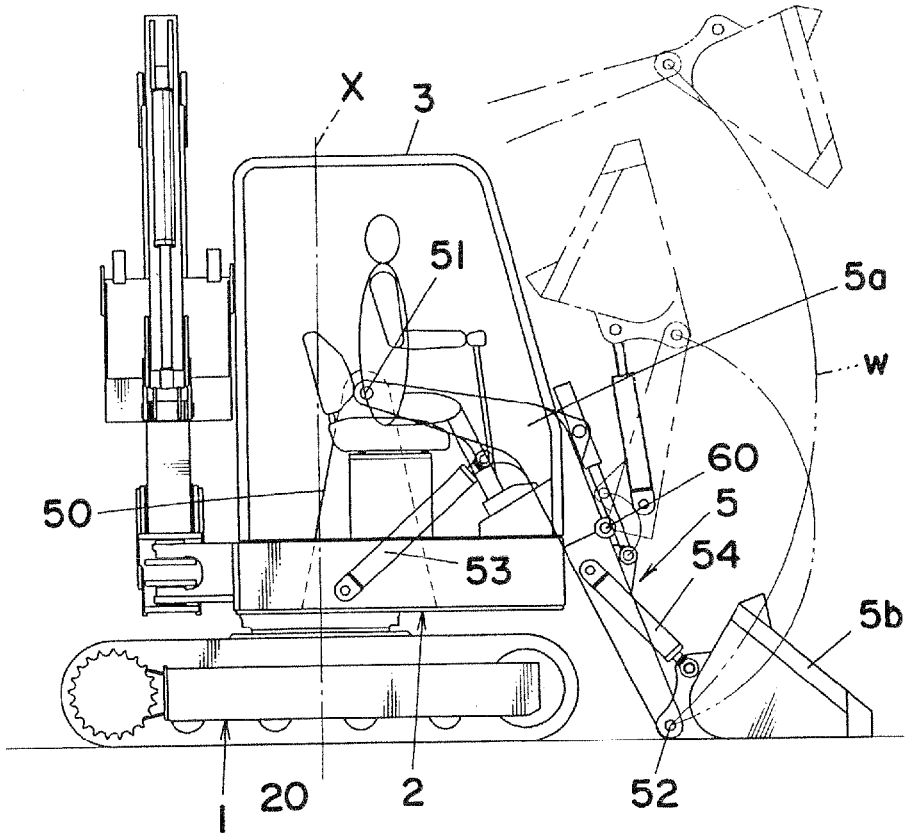
FIG. 5 is a side view of the construction vehicle shown in FIG. 1 when performing a loading work by the loading machine, while keeping an unused excavating machine in a state of being folded and retracted.

FIGS. 1 to 5 depict a construction vehicle of an all-round traverse type according to an embodiment of the present invention. FIG. 1 is a side view of the whole construction vehicle; FIG. 2 is a front view of the construction vehicle; FIG. 3 is a side view of the construction vehicle in a state where working machines are folded and retracted; FIG. 4 is a side view of the construction vehicle in operation when performing an excavating work by an excavating machine, while a loading machine is folded and retracted; and FIG. 5 is a side view of the construction vehicle in operation when performing a loading work by the loading machine, while the excavating machine is folded and retracted. The embodiment is an example where an excavator is used as an excavating machine, and a bucket loader is used as a loading machine, therefore, the excavating machine and the loading machine are explained as the excavator and the bucket loader, respectively.

According to the figures of the drawings, a reference numeral 1 denotes a vehicle body; a reference numeral 2 denotes a turn frame that is mounted on the upper side of the vehicle body 1 so as to turn 360 degrees via a turn bearing 20 that turns with respect to a vertical rotational axis; a reference numeral 3 denotes a cabin that is mounted on the upper side of the turn frame 2 in a manner of being shifted to one side of right and left sides of the turn frame 2; a reference numeral 4 denotes an excavator that is mounted on the front end of the turn frame 2 as arranged in front of the cabin 3; a reference numeral 5 denotes a bucket loader that is mounted on the turn frame 2 as arranged on the rear side of the cabin 3; and a reference numeral 6 denotes a power source that includes an engine, a hydraulic power unit, and the like, which are mounted in parallel with the cabin 3 on the other side of the upper side of the turn frame 2.

The vehicle body 1 is a usual vehicle configured to run by driving travel devices 10 that include crawlers with a hydraulic motor that operates with pressure oil brought from the power source 6.

The turn frame 2 is mounted on the upper surface of the vehicle body 1 via the turn bearing 20 in a rotatable manner, and configured to carry out an all-round traverse of 360 degrees around a rotational center line X in the vertical direction, which is a rotational axis of the turn bearing 20, by operating the turn bearing 20 by the hydraulic motor driven with pressure oil brought from the power source.

The cabin 3 is mounted on the upper surface of the turn frame 2, a driver seat 30 to be placed and installed on the upper surface of the turn frame 2 is arranged inside a room of the cabin 3, and moreover, an operation device 31 for controlling the engine of the power source 6 and a controller of a hydraulic circuit of the hydraulic power unit is placed around the driver seat 30.

Among the driver seat 30 placed inside the cabin 3 and the operation device 31 arranged around the driver seat 30, the driver seat 30 is provided in a rotatable manner to switch between a position facing forward as shown in FIG. 4 and a position facing backward as shown in FIG. 5, while the operation device 31 is arranged each in front of the seat when a driver sits on the seat in an attitude of facing forward as shown in FIG. 4, and in front of the seat when the driver sits on the seat in an attitude of facing backward as shown in FIG. 5.

The excavator 4 is a usual excavating machine, and includes a boom 4*a*, an arm 4*b*, and a bucket 4*c*. The boom 4*a* is connected and pivotally supported on one end via a boom pin 43 to and by a fitting 42 assembled via a mounting pin 41 onto a mounting bracket 40 provided at the front end of the turn frame 2 in a manner such that the boom 4*a* can rise and fall or turn as required. A boom cylinder 46 that is arranged between the fitting 42 and the boom 4*a* so as to bridge therebetween is telescopically moved in accordance with control of the hydraulic circuit, thereby moving up and down and turning the boom 4*a* around the boom pin 43. The boom 4*a* is pivotally connected at the other to the root end of the arm 4*b* via a pin 44. The tip end of the arm 4*b* is pivotally connected to the bucket 4*c* via a pin 45. An arm cylinder 47 that bridges between the middle part of the boom 4*a* and the root end of the arm 4*b* is telescopically moved with supplied pressure oil, thereby turning the arm 4*b* to a desired angle with respect to the boom 4*a*. A dump link 48 that bridges between the tip end of the arm 4*b* and the bucket 4*c* is telescopically moved with a oil pressure of a bucket cylinder 49 that is arranged between the dump link 48 and the root end of the arm 4*b* to bridge therebetween, thereby making a dumping-turn 15 of the bucket 4*c* to a desired angle with respect to the arm 4*b*. In this way, the excavator 4 performs an excavating work.

According to the excavator 4 of the excavating machine, the fitting 42 that assembles the root end of the boom 4*a* onto the mounting bracket 40 is formed as a swing post that makes a swing leftward and rightward with respect to the mounting bracket 40 with the mounting pin 41 that is a post pin in the vertical direction. The excavator 4 is configured to turn leftward and rightward to a desired angle by a telescopic movement with oil pressure of a swing cylinder 42*a* that is arranged between the fitting 42 as the swing post and the turn frame 2 to bridge therebetween.

Figure 6:
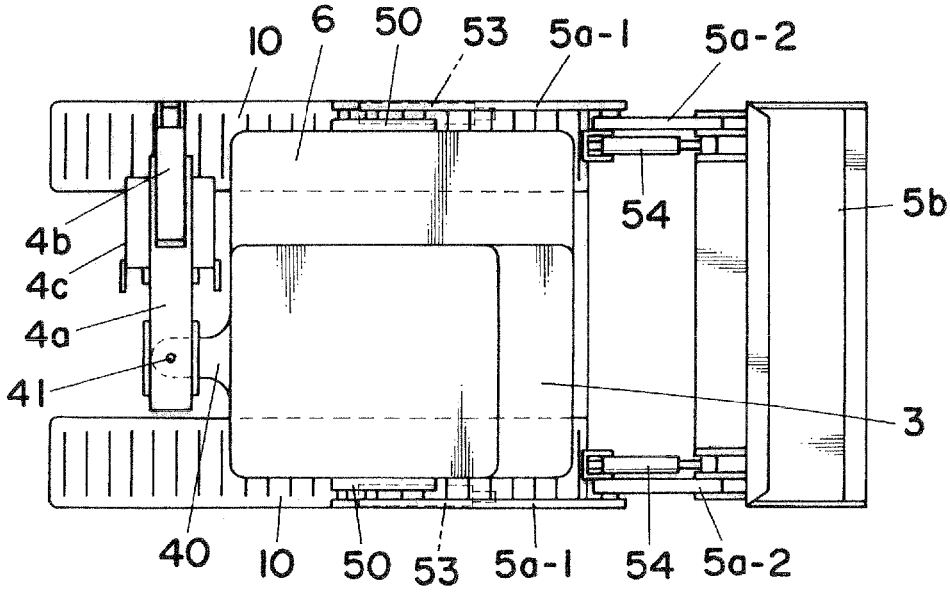
FIG. 6 is a plan view of the construction vehicle shown in FIG. 1.
Figure 7:
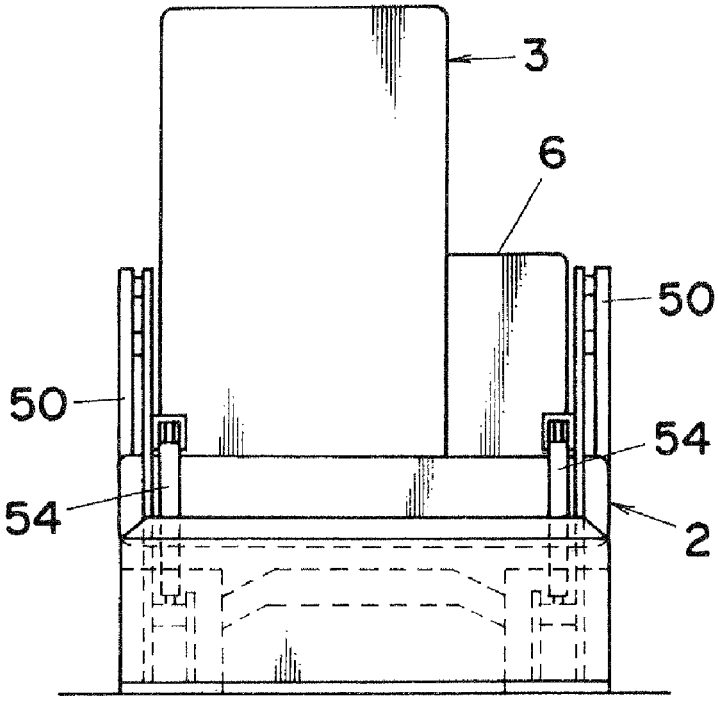
FIG. 7 is a back view of the construction vehicle shown in FIG. 1.
Figure 8:
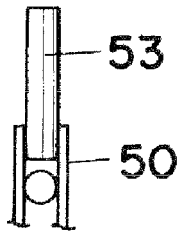
FIG. 8 is al plan view of a part of the construction vehicle shown in FIG. 1.

As shown in FIGS. 2 and 6, the mounting bracket 40 onto which the fitting 42 is assembled is provided on the front surface of the turn frame 2 as arranged so as to occupy a substantially center position between the right and the left of the front side of the cabin 3 that is mounted on the turn frame 2 in a manner of being shifted to one side of the right and left sides with respect to a center line Y between the right and the left of the vehicle body 1.

Accordingly, as the cabin 3 is mounted on the turn frame 2 in parallel with the power source 6, the excavator 4 provided at the front end of the turn frame 2 is positioned at the substantially center between the right and the left of the front side of the cabin 3 provided on the turn frame 2 as shifted to one side of the right and left sides. Moreover, the excavator 4 is configured to be retracted under an unused state into a sideways attitude along the front surface of the cabin 3 as shown in FIGS. 2 and 3 by folding the arm 4*b*, holding the bucket 4*c* in the inside space, standing the boom 4*a*, and turning the fitting 42 by a substantially right angle with respect to the mounting bracket 40. The unused and retracted state is kept by providing and operating a locking mechanism 70 in manual operation or automatic operation, such as a hydraulic locking device to be provided in a hydraulic circuit, a mechanical locking device, or an electronic locking device. The bucket loader 5 of the loading machine mounted on the machine body of the construction vehicle A is arranged on the rear side of the cabin 3 and includes booms 5*a*, 5*a*, bucket 5*b*, boom cylinders 53, and bucket cylinders 54. The booms 5*a* are long fore and 15 aft, each connected via a boom pin 51 that is a connecting pin to each of boom stands 50 of which root end is provided on the machine body of the construction vehicle, and supported on the machine body such that the tip ends of the booms 5*a* can rise and fall and turn. The bucket 5*b* is connected to the tip ends of the booms 5*a* via bucket pins 52 so as to take a dumping-turn. The boom cylinders 53 that are hydraulically operated are each 20 provided between the machine body and the middle part in the longitudinal direction of each of the booms 5*a* to bridge therebetween, and configured to move up and down and to turn the booms 5*a* around the boom pins 51 at the root ends of the booms 5*a*. The bucket cylinders 54 that are hydraulically operated are each provided between the tip ends of the booms 5*a* and the bucket 5*b* to bridge therebetween, and configured to turn the bucket 5*b* 25 around the bucket pins 52. The booms 5*a* are configured such that two booms formed in the same shape are arranged in parallel to make a pair opposing to each other on the right and the left, and the booms are moved up and down and turned by the boom cylinders 53. The bucket 5*b* is formed in a semicylindrical shape that is long between the right side and the left side, and supported between the tip ends of the pair of the booms 5*a* and 5*a* arranged in parallel to bridge therebetween. The right and left ends of the bottom of the bucket 5*b* are connected to the respective tip ends of the booms 5*a* and 5*a* arranged on right and left sides in parallel via the bucket pins 52 that are connecting pins in the traverse direction in a rotatable manner, so as to make a bumping-turn with the bucket 5 cylinders 54. The basic configuration of the bucket loader 5 is not different from a usual bucket loader.

However, according to the bucket loader 5 of the loading machine, the boom stands 50 are mount bases for assembling and supporting the bucket loader 5 onto the machine body by pivotally supporting the respective root ends of the pair of the booms 5*a* right and left, arranged at the substantially center in the fore and aft direction of the turn frame 2 on respective lateral sides of the right and left of the turn frame 2, and provided so as to stand from a bottom wall 21 that is a base of the turn frame 2, so that each of the boom pins 51 for pivotally supporting the root end of each of the booms 5*a* occupies a high position elevated from the floor of the cabin 3 in the middle of its lateral side in the fore and aft direction in a side view as shown in FIG. 5. Accordingly, when the booms 5*a* are mounted on the bucket loader 5 as the root ends of the booms 5*a* are connected and pivotally supported to and by the boom pins 51, the most part of the booms 5*a* overlaps with the lateral surfaces of the cabin 3, and the booms 5*a* are pulled into the lateral position of the cabin 3; and the bucket 5*b* and tip-end sides 5*a*-2 that supports the bucket 5*b* are mounted and pivotally supported such that when the booms 5*a* are lowered outward of the rear side of the cabin 3, and the bucket 5*b* supported on the tip ends of the booms 5*a* is grounded as shown in FIG. 1, the bucket 5*b* and the tip-end sides 5*a*-2 are to be positioned outside of the rear side of the cabin 3 in a side view and a plan view.

As shown in FIG. 5, the booms 5*a* built and supported on the boom stands 50 via the boom pins 51 are configured such that the booms 5*a* are connected and pivotally supported to and by the boom stands 50 installed in the middle position in the fore and aft direction on the lateral sides of the turn frame 2; when the tip ends of the booms 5*a* are lowered and the bucket 5*b* pivotally supported on the tip ends is grounded, each of the booms 5*a* is divided into two parts, namely a root-end side 5*a*-1 and the tip-end side 5*a*-2, at the center in the longitudinal direction of the boom 5*a*, the root-end side 5*a*-1 overlapping with the cabin 3 in a side view, and the tip-end side 5*a*-2 projecting forward of the cabin 3; and the tip-end side 5*a*-2 is connected to the root-end side 5*a*-1 such that the tip-end side 5*a*-2 folds and turns upward and does not told and turn downward owing to a joint pivot 60 positioned on the upper side of the boom 5*a*, and mating portions 61 and 62 provided so as to mate divided portions by matching them, thereby connecting the tip-end side 5*a*-2 to the root-end side 5*a*-1 such that the tip-end side 5*a*-2 folds and turns upward and does not fold and turn downward. A tilt cylinder 63 that is hydraulically operated for turning the tip-end side 5*a*-2 toward the root-end side 5*a*-1 is provided on the upper side of the booms 5*a* between the root-end side 5*a*-1 and the tip-end side 5*a*-2 to bridge therebetween.

Consequently, according to the bucket loader 5 of the loading machine, when an operator inside the cabin 3 operates the bucket loader 5 by operating the operation device 31, the bucket 5*b* provided on the tip ends of the booms 5*a* rises and falls while making a trail indicated by a virtual line w shown in FIG. 5 and performs loading works. When the booms 5*a* is in a lowered position as shown in FIG. 5, and the tip-end side 5*a*-2 is turned upward with the tilt cylinder 63, the bucket loader 5 occupies a position in the vicinity of the cabin 3 along its front surface, so that the bucket loader 5 takes a retracted attitude along the front surface of the cabin 3.

The attitude of the bucket loader 5 is kept by a manual locking device or an automatic locking device that is installed on the machine body.

Accordingly, when not performing loading work and not using the bucket loader 5, the bucket loader 5 supported on one side of the front and rear sides of the cabin 3 can be folded and retracted into an attitude along a surface of front side or the rear side of the cabin 3, thereby avoiding obstructing an excavating work when performing the excavating work while turning the turn frame 2 by using the excavator 4 supported on the other side of the front side and rear side of the cabin 3.

A construction vehicle according to the present invention is configured such that an excavator of an excavating machine and a bucket loader of a loading machine are supported on a turn frame provided on the upper side of a vehicle body in an integrated form that the excavator of the excavating machine is positioned on the front side of the vehicle body and the bucket loader of the loading machine is positioned on the rear side of the vehicle body, which means the construction vehicle includes two different kinds of working machines, namely, the excavating machine and the loading machine, each of which is an all-round traverse type; and moreover, the construction vehicle can perform a work by turning a working machine without problem, because when working by using one of the working machines, the other working machine that is unused can be kept in a retracted state in a retracted attitude along a surface of the front side or the rear side of a cabin.

Moreover, a user can possess both a construction vehicle equipped with an excavating machine and a construction vehicle equipped with a loading machine by possessing one construction vehicle, so that costs to the user can be substantially reduced.

Although, in the foregoing, the present invention has been described in detail with reference to the specific mode of embodiments as shown in the accompanying drawings, it should be understood that the present invention is not limited to the embodiments alone, but any changes and modifications may be made within the spirit and the scope of the present invention as recited in the appended claims.

What is claimed is:

1. A construction vehicle comprising:

a turn frame (2) that turns 360 degrees via a turn bearing (20) around a rotational axis in a vertical direction and is mounted on a vehicle body (1) configured to run with a travel device (10), a cabin (3) in which a driver seat and a control device are placed, a power source (6) including an engine and a hydraulic rower unit, said cabin (3) and said power source (6) being mounted on an upper side of said turn frame (2) in parallel with and adjacent to one another, an excavator (4) mounted on a rear side of said turn frame (2), and a bucket loader (5) mounted on a front side of said turn frame (2), wherein said excavator (4) mounted on the rear side of said turn frame (2) is configured to be retracted substantially within a right and left width of said turn frame (2) in a front view in a manner such that a mounting bracket (40) configured to mount thereon said excavator (4) is provided on the rear side of said turn frame (2) in a position shifted from a center line (Y) between right and left of said vehicle body (1) to one side of right and left sides of said vehicle body (1), said excavator (4) includes a boom (4*a*), an arm (4*b*), and a bucket (4*c*) that are connected in a bendable and turnable manner, a fitting (42) and a vertical post pin (41) that extends in a vertical direction are provided at a root end of the boom (4*a*), said excavator (4) is assembled on said mounting bracket (40) in a manner turnable rightward and leftward with said fitting (42) and said post pin (41), a swing cylinder (42*a*) swivels said fitting (42) rightward and leftward by a desired angle with oil pressure, and arranged between said fitting (42) and said turn frame (2) to bridge therebetween, and said boom (4*a*) and said arm (4*b*) come into a folded position, and then are swiveled to a sideways orientation by said swing cylinder (42*a*), said bucket loader (5) mounted on the front side of said turn frame (2) is configured to be folded and retracted into a position along a front side of said cabin (3) in a manner such that boom stands (50) configured to mount thereon said bucket loader (5) are provided to stand respectively on right and left lateral sides of said turn frame (2) and at a substantial center in a fore and aft direction of said turn frame (2) so as to extend upward from a bottom wall of said turn frame (2), a pair of booms (5*a*) is arranged on right and left sides in parallel, and turns up and down around respective boom pins (51) by boom cylinders (53), said bucket loader (5) is supported by said booms (5*a*) and (5*a*) so as to bridge between tips of said booms (5*a*), said boom stands (50) axially support said booms (5*a*) and said bucket loader (5) by connecting root ends of said booms (5*a*) to upper ends of said boom stands (50) with boom pins (51), each of said booms (5*a*) is divided into a root side (5*a*-1) and a tip side (5*a*-2), said root side (5*a*-1) overlapping with said cabin (3) and said tip side (5*a*-2) projecting forward from said cabin (3) in a side view under a state that a bucket (5*b*) provided on a tip of bucket loader (5) is in contact with a ground by turning said right and left booms (5*a*) and (5*a*) downwardly with said boom cylinders (53), said root side (5*a*-1) and said tip side (5*a*-2) are connected such that said tip side (5*a*-2) can be folded and turned upwardly with respect to said root side (5*a*-1), and cannot be folded and turned downwardly, a tilt cylinder (63) is connected to bridge between said root side (5*a*-1) and said tip side (5*a*-2), and said tip side (5*a*-2) is turned upwardly by operating said tilt cylinder (63) from said state that said booms (5*a*) and (5*a*) are turned down.

2. The construction vehicle according to claim 1, further comprising a locking device that causes said excavator (4) and said bucket loader (5) to hold a folded and retracted state when said excavator (4) and said bucket loader (5) are folded and retracted, wherein said excavator (4) is arranged on the rear side of said turn frame (2) and a rear side of said cabin (3), and mounted so as to turn into a sideways retracted orientation, said bucket loader (5) is arranged on the front side of said turn frame (2) and a front side of said cabin (3), and mounted on said turn frame (2), said locking device is included in a locking device for hydraulic actuation, so that said locking device is provided in a hydraulic circuit that actuates said excavator (4) and said bucket loader (5).

* * * * *